US009267678B2

(12) United States Patent
Brückner et al.

(10) Patent No.: US 9,267,678 B2
(45) Date of Patent: Feb. 23, 2016

(54) CONTINUOUS STEAM GENERATOR

(75) Inventors: Jan Brückner, Uttenreuth (DE); Martin Effert, Erlangen (DE); Joachim Franke, Nürnberg (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 536 days.

(21) Appl. No.: 13/062,700

(22) PCT Filed: Sep. 9, 2009

(86) PCT No.: PCT/EP2009/061677

§ 371 (c)(1),
(2), (4) Date: Mar. 8, 2011

(87) PCT Pub. No.: WO2010/029100

PCT Pub. Date: Mar. 18, 2010

(65) Prior Publication Data

US 2011/0197830 A1 Aug. 18, 2011

(30) Foreign Application Priority Data

Sep. 9, 2008 (EP) ..... 08015862

(51) Int. Cl.

| | |
|---|---|
| ***F22B 29/06*** | (2006.01) |
| ***F22B 5/02*** | (2006.01) |
| ***F22B 37/26*** | (2006.01) |
| ***F22G 3/00*** | (2006.01) |
| ***F22B 1/00*** | (2006.01) |
| ***F01K 21/06*** | (2006.01) |
| ***F22G 5/02*** | (2006.01) |
| ***F22B 21/34*** | (2006.01) |

(52) U.S. Cl.
CPC ..... *F22B 29/06* (2013.01); *F22B 21/341* (2013.01); *F22B 37/26* (2013.01)

(58) Field of Classification Search
None
See application file for complete search history.

(56) References Cited

U.S. PATENT DOCUMENTS

| | | | | | |
|---|---|---|---|---|---|
| 2,048,393 | A | * | 7/1936 | Kroger | 122/37 |
| 2,201,618 | A | * | 5/1940 | La Mont | 122/250 R |
| 2,201,620 | A | * | 5/1940 | La Mont | 122/250 R |

(Continued)

FOREIGN PATENT DOCUMENTS

| | | | | | |
|---|---|---|---|---|---|
| DE | 102007024934 | A1 | * | 12/2008 | B01J 8/06 |
| EP | 1701091 | A1 | | 9/2006 | |

(Continued)

*Primary Examiner* — Gregory Huson
*Assistant Examiner* — Eric Gorman

(57) ABSTRACT

A continuous steam generator including a combustion chamber with a plurality of burners for fossil fuel is provided. A vertical gas duct is connected downstream of the combustion chamber on the hot gas side, in an upper region via a horizontal gas duct. The outside wall of the combustion chamber is formed from evaporation pipes which are welded together in a gas-tight manner and mounted upstream of a water separator system on the flow medium side and from superheater pipes which are welded together in a gas-tight manner and mounted downstream of the water separator system. The water separator system includes a plurality of water separation elements, each element includes an inlet tube which is connected to the respective upstream evaporation for tubes, which extend into a water evacuation tube. A distributer element is arranged on the evaporator side between the respective water separator element and the inlet collector.

3 Claims, 2 Drawing Sheets

(56) References Cited

U.S. PATENT DOCUMENTS

| | | | | | |
|---|---|---|---|---|---|
| 2,268,559 | A * | 1/1942 | Bailey | 122/235.26 | |
| 2,679,831 | A * | 6/1954 | Henkel | 122/386 | |
| 2,685,280 | A * | 8/1954 | Blaskowski | 122/479.1 | |
| 2,952,975 | A * | 9/1960 | Braddy | 60/39.182 | |
| 3,021,824 | A * | 2/1962 | Profos | 122/406.4 | |
| 3,227,142 | A * | 1/1966 | Lawrence et al. | 122/34 | |
| 3,267,908 | A * | 8/1966 | Sharan | 122/235.11 | |
| 3,280,559 | A * | 10/1966 | Hutchings | 60/679 | |
| 3,296,779 | A * | 1/1967 | Daman et al. | 55/337 | |
| 3,320,934 | A * | 5/1967 | Doell | F22B 29/06 | 122/406.4 |
| 3,403,722 | A * | 10/1968 | Woebcke | 165/140 | |
| 3,407,789 | A * | 10/1968 | Hallee et al. | 122/356 | |
| 3,854,453 | A * | 12/1974 | Mayer et al. | 122/32 | |
| 3,924,575 | A * | 12/1975 | Zipay | 122/34 | |
| 3,956,898 | A * | 5/1976 | Horlitz, Jr. | F22G 1/16 | 122/448.3 |
| 4,075,978 | A * | 2/1978 | Friedrich | F22B 1/12 | 112/33 |
| 4,098,324 | A * | 7/1978 | Kummel et al. | 165/104.31 | |
| 4,278,050 | A * | 7/1981 | Kime | 122/39 | |
| 4,318,441 | A * | 3/1982 | Belleli | 165/81 | |
| 4,343,351 | A * | 8/1982 | Belleli | 165/81 | |
| 4,446,820 | A * | 5/1984 | Jansing et al. | 122/32 | |
| 4,484,531 | A * | 11/1984 | Firey | 110/342 | |
| 5,529,021 | A * | 6/1996 | Butterlin et al. | 122/448.1 | |
| 5,839,396 | A * | 11/1998 | Franke et al. | 122/406.5 | |
| 5,979,370 | A * | 11/1999 | Franke | 122/235.14 | |
| 5,983,639 | A * | 11/1999 | Kral et al. | 60/646 | |
| 6,019,070 | A * | 2/2000 | Duffy | 122/209.1 | |
| 6,192,837 | B1 * | 2/2001 | Wittchow | 122/406.4 | |
| 6,446,580 | B2 * | 9/2002 | Franke et al. | 122/6 A | |
| 6,446,584 | B1 * | 9/2002 | Franke et al. | 122/460 | |
| 6,481,386 | B2 * | 11/2002 | Wittchow | 122/6 A | |
| 6,499,440 | B2 * | 12/2002 | Franke et al. | 122/459 | |
| 6,536,380 | B1 * | 3/2003 | Kral et al. | 122/406.4 | |
| 6,557,499 | B2 * | 5/2003 | Franke et al. | 122/1 B | |
| 6,715,450 | B1 * | 4/2004 | Wittchow | 122/1 B | |
| 7,628,124 | B2 * | 12/2009 | Bruckner et al. | 122/470 | |
| 2002/0000208 | A1 * | 1/2002 | Franke et al. | 122/459 | |
| 2002/0017251 | A1 * | 2/2002 | Wittchow | 122/459 | |
| 2002/0026906 | A1 * | 3/2002 | Franke et al. | 122/460 | |
| 2004/0149239 | A1 * | 8/2004 | Franke et al. | 122/406.4 | |
| 2004/0219079 | A1 * | 11/2004 | Hagen et al. | 422/194 | |
| 2005/0120715 | A1 * | 6/2005 | Labrador | 60/618 | |
| 2005/0247619 | A1 * | 11/2005 | Berger et al. | 210/321.89 | |
| 2006/0075977 | A1 * | 4/2006 | Franke et al. | 122/406.4 | |
| 2006/0192023 | A1 * | 8/2006 | Franke et al. | 237/67 | |
| 2008/0115743 | A1 * | 5/2008 | Effert et al. | 122/7 R | |
| 2008/0155985 | A1 * | 7/2008 | Labrador | 60/698 | |
| 2008/0257282 | A1 * | 10/2008 | Effert et al. | 122/1 R | |
| 2009/0010821 | A1 * | 1/2009 | Lehr | 422/197 | |
| 2009/0071419 | A1 * | 3/2009 | Franke et al. | 122/7 R | |
| 2011/0162592 | A1 * | 7/2011 | Effert | F22B 1/345 | 122/406.4 |
| 2011/0315094 | A1 * | 12/2011 | Bruckner et al. | 122/7 R | |
| 2011/0315095 | A1 * | 12/2011 | Bruckner et al. | 122/7 R | |
| 2012/0024241 | A1 * | 2/2012 | Bruckner et al. | 122/7 R | |
| 2012/0073520 | A1 * | 3/2012 | Bruckner et al. | 122/7 R | |
| 2012/0180739 | A1 * | 7/2012 | Rop | F22B 1/18 | 122/7 R |
| 2013/0312946 | A1 * | 11/2013 | Chan et al. | 165/281 | |
| 2014/0000845 | A1 * | 1/2014 | Vanderwees et al. | 165/83 | |
| 2014/0165650 | A1 * | 6/2014 | Jibb et al. | 62/648 | |

FOREIGN PATENT DOCUMENTS

| | | | | |
|---|---|---|---|---|
| EP | 1710498 | A1 | 10/2006 | |
| FR | 2474648 | A * | 7/1981 | F22B 27/16 |
| GB | 893371 | | 7/1958 | |
| GB | 991911 | A * | 5/1965 | |
| GB | 2015129 | | 9/1979 | |

* cited by examiner

CONTINUOUS STEAM GENERATOR

CROSS REFERENCE TO RELATED APPLICATIONS

This application is the US National Stage of International Application No. PCT/EP2009/061677, filed Sep. 9, 2009 and claims the benefit thereof. The International Application claims the benefits of European Patent Office application No. 08015862.9 EP filed Sep. 9, 2008. All of the applications are incorporated by reference herein in their entirety.

FIELD OF INVENTION

The invention relates to a continuous ("once-through") steam generator which comprises a combustion chamber having a plurality of burners for fossil fuel and downstream of which a vertical gas duct is connected on the hot gas side in an upper region via a horizontal gas duct, wherein the external wall of the combustion chamber is formed from evaporator tubes that are welded to one another in a gas-tight manner and disposed upstream of a water separation system on the flow medium side and from superheater tubes that are welded to one another in a gas-tight manner and disposed downstream of the water separation system on the flow medium side, wherein the water separation system comprises a plurality of water separating elements, each of the water separating elements comprising an inflow tube section which is connected to the respective upstream evaporator tubes and, viewed in its longitudinal direction, transitions into a water discharge tube section, wherein a plurality of outflow tube sections branch off in the transition zone, said outflow tube sections being connected to an inlet collector of the respective downstream superheater tubes.

BACKGROUND OF INVENTION

In a fossil-fired steam generator the energy of a fossil fuel is used to generate superheated steam which can subsequently be supplied to a steam turbine for the purpose of generating electricity, in a power station for example. In particular at the steam temperatures and pressures typical in a power station environment, steam generators are generally implemented as water tube boilers, which is to say that the supplied water flows in a plurality of tubes which assimilate the energy in the form of radiant heat from the burner flames and/or through convection and/or through thermal conduction from the flue gas being produced during the combustion process.

In the region of the burners the steam generator tubes in this case typically form the combustion chamber wall in that they are welded to one another in a gas-tight arrangement. Steam generator tubes disposed in the flue gas duct can also be provided in other areas downstream of the combustion chamber on the flue gas side.

Fossil-fired steam generators can be categorized according to a multiplicity of criteria. For example, steam generators can be classified into vertical and horizontal design types, based on the flow direction of the gas flow. In the context of fossil-fired steam generators constructed in a vertical design a distinction is generally made in this case between one-pass and two-pass boilers.

In a single-pass or tower-type boiler the flue gas generated as a result of the combustion process in the combustion chamber always flows vertically from bottom to top. All the heating surfaces disposed in the flue gas duct are located on the flue gas side above the combustion chamber. Tower-type boilers offer a comparatively simple construction and simple containment of the stresses resulting due to the thermal expansion of the tubes. Furthermore, all the heating surfaces of the steam generator tubes disposed in the flue gas duct are horizontal and can therefore be drained of water completely, which can be desirable in environments exposed to risk of frost.

In the case of the two-pass boiler a horizontal gas duct is connected downstream in an upper region of the combustion chamber on the flue gas side, said horizontal gas duct leading into a vertical gas duct. In this second vertical gas duct the gas usually flows vertically from top to bottom. In the two-pass boiler there is therefore a multiple redirection of the flue gas. Advantages of this type of design are, for example, the lower overall height of the structure and the lower manufacturing costs resulting therefrom.

Furthermore, steam generators can be implemented as gravity circulation, forced circulation or once-through steam generators. In a once-through steam generator the heating of a plurality of evaporator tubes leads to a complete evaporation of the flow medium in the evaporator tubes in a single pass. Following its evaporation the flow medium—typically water—is supplied to superheater tubes connected downstream of the evaporator tubes and is superheated there. The position of the evaporation endpoint, i.e. the location at which the water component of the flow has totally evaporated, is in this case variable and dependent on operating mode. During full-load operation of a once-through steam generator of this type the evaporation endpoint is located for example in an end region of the evaporator tubes, such that the superheating of the evaporated flow medium commences already in the evaporator tubes (with the nomenclature used, this description is, strictly speaking, only valid for partial loads with subcritical pressure in the evaporator. For clarity of illustration purposes, however, this manner of presentation is used throughout in the following description).

In contrast to a gravity circulation or forced circulation steam generator, a once-through steam generator is not subject to any pressure limiting, which means that it can be dimensioned for live steam pressures far in excess of the critical pressure of water ($P_{Cri}$≈221 bar)—at which water and steam cannot occur simultaneously at any temperature and consequently also no phase separation is possible.

In low-load operation or during the startup phase a once-through steam generator of said type is usually operated at a minimum flow of flow medium in the evaporator tubes in order to ensure reliable cooling of the evaporator tubes. Toward that end, particularly at low loads of, for example, less than 40% of the design load, the pure once-through mass flow through the evaporator is usually no longer sufficient in itself to cool the evaporator tubes and for that reason an additional throughput of flow medium is superimposed in the course of the circulation on the once-through pass of flow medium through the evaporator. The minimum flow of flow medium in the evaporator tubes that is provided under normal operating conditions is consequently not completely evaporated in the evaporator tubes during the startup phase or in low-load operation, with the result that in an operating mode of said type unevaporated flow medium, in particular a water-steam mixture, is still present at the end of the evaporator tubes.

However, since the superheater tubes which are typically connected downstream of the evaporator tubes of the once-through steam generator only after the flow medium has passed through the combustion chamber walls are not designed for a throughflow of unevaporated flow medium, once-through steam generators are generally implemented in such a way that an ingress of water into the superheater tubes is reliably avoided also during the startup phase and in low-load operation. Toward that end the evaporator tubes are typically connected to the superheater tubes disposed downstream of them by way of a water separation system. In this arrangement the water separator effects a separation of the water-steam mixture emerging from the evaporator tubes during the startup phase or in low-load operation into water and steam. The steam is supplied to the superheater tubes connected downstream of the water separator, whereas the separated water is returned to the evaporator tubes via a circulating pump, for example, or can be discharged by way of a blowdown tank.

In this arrangement the water separation system can comprise a multiplicity of water separating elements which are directly integrated into the tubes. In this case a water separating element can be associated in particular with each of the evaporator tubes connected in parallel. Furthermore, the water separating elements can be embodied as what are called T-piece water separating elements. Here, each T-piece water separating element comprises an inflow tube section connected in each case to the upstream evaporator tube and, viewed in its longitudinal direction, transitions into a water discharge tube section, with an outflow tube section connected to the downstream superheater tube branching off in the transition zone.

By virtue of this type of design the T-piece water separating element is embodied for effecting an inertial separation of the water-steam mixture flowing out of the upstream evaporator tube and into the inflow tube section. Specifically, owing to its comparatively high level of inertia the water fraction of the flow medium flowing in the inflow tube section by preference continues to flow straight on past the transition point in an axial extension of the inflow tube section and consequently passes into the water discharge tube section and from there usually flows further into a connected collecting vessel. By contrast, the steam fraction of the water-steam mixture flowing in the inflow tube section is better able, by virtue of its comparatively low level of inertia, to follow an imposed redirection and consequently flows via the outflow tube section to the downstream superheater tube section. A once-through steam generator based on this type of design is known, for example, from EP 1 701 091.

In a once-through steam generator having a water separation system configured in such a way the decentralized integration of the water separation function into the individual tubes of the tube system of the once-through steam generator means that the water can be separated without prior collection of the flow medium flowing out of the evaporator tubes. It also means that the flow medium can be passed on directly into the downstream superheater tubes.

Owing to the manner of construction the transfer of flow medium to the superheater tubes is furthermore not restricted just to steam; rather, a water-steam mixture can now also be passed on to the superheater tubes through overfeeding of the water separating elements. By this means the evaporation endpoint can be shifted into the superheater tubes as necessary. This enables a particularly high level of operational flexibility to be achieved even during the startup phase or in the low-load mode of operation of the once-through steam generator. In particular the live steam temperature can be regulated within comparatively wide limits by controlling the feedwater volume.

With systems of this kind it is, however, necessary to take into account that because the water separation function is integrated into the individual tubes a comparatively high number of individual tube sections or elements is required specifically in the region of the separation system.

SUMMARY OF INVENTION

The object underlying the invention is therefore to disclose a once-through steam generator of the type cited in the introduction which, at the same time as maintaining a particularly high level of operational flexibility, is associated with comparatively low costs in terms of construction and repair.

This object is achieved according to the invention in that a distributor element is disposed on the steam side between the respective water separating element and the inlet collector.

In this case the invention proceeds on the basis of the consideration that due to the decentralized water separation that takes place separately in each of the parallel-connected evaporator tubes in the above-described design, a comparatively large number of T-piece water separating elements can lead to constructional problems in large-scale industrial application. Due to the space problems that the necessity of accommodating such a large number of water separating elements can entail, this type of design can also give rise to considerable additional costs as a result of the high constructional overhead associated with it, as well as being subject to restrictions in terms of the geometric parameters of the once-through steam generator.

A reduction in the constructional complexity of the once-through steam generator could be achieved by a simpler configuration of the water separation system. Toward that end the number of water separating elements used can be reduced. However, in order to maintain the advantages of decentralized water separation, such as the possibility of feedthrough with a water-steam mixture for example, the basic design in the form of T-piece water separating elements should be retained. The combination of the two aforementioned concepts can be achieved through a collection of the flow medium from a plurality of evaporator tubes in each case in one water separating element in each case.

As a result of a reduction in the number of T-piece water separating elements, direct steam-side forwarding to the inlet collectors of the downstream superheater tubes can, however, lead to inhomogeneities in the distribution to the different superheater tubes. In order to achieve a uniform distribution to the downstream superheater tubes after the steam or the water-steam mixture emerges from the T-piece water separating element, a distributor element is therefore disposed on the steam side between the respective water separating element and the inlet collector.

Advantageously, the geometric parameters of a number of outlet tubes are chosen such that a homogeneous flow distribution to the inlet collector of the downstream superheater tubes in each case is ensured. This already achieves a homogeneous input into the inlet collector, which continues accordingly into the downstream superheater tubes. In this case the outlet tubes can have the same diameter, for example, and be routed parallel to one another into the inlet collector at uniform intervals.

In an advantageous embodiment the distributor element is configured as a star-type distributor, i.e. it comprises a baffle plate, an inlet tube arranged vertically with respect to the baffle plate, and a plurality of outlet tubes arranged in a star shape around the baffle plate in the plane thereof. The inflowing water impinges on the baffle plate and is distributed in a symmetrical manner vertically with respect to the inflow direction and conducted into the outlet tubes. In a particularly advantageous embodiment the baffle plate is circular in this arrangement and the outlet tubes are arranged concentrically with respect to the center of the baffle plate at equal spacings from the respective adjacent outlet tubes. In this way a particularly homogeneous distribution to the various outlet tubes is ensured.

In this case between five and twenty outlet tubes are advantageously provided per distributor element. If a lower number were used an adequate homogenization of the input of steam or water-steam mixture into the inlet collector could no longer be guaranteed, whereas a higher number can be problematic in terms of the geometric embodiment of the distributor element, in particular when the latter is configured as a star-type distributor.

The advantages achieved by means of the invention consist in particular in that even with a substantially smaller number of water separating elements a uniform distribution of the flow medium to the superheater tubes is achieved thanks to the steam-side arrangement of an additional distributor element between the respective water separating element and the inlet collector of the downstream superheater heating surfaces. These measures are a prerequisite for the reduction in the number of water separating elements to be made possible at all. This means a considerable reduction in manufacturing overhead and a comparatively low level of complexity of the tube system of the once-through steam generator and a particularly high level of operational flexibility can be achieved even during the startup phase or in low-load operation.

Furthermore, a homogeneous temperature distribution over the downstream superheater tubes is made possible, which leads to significantly lower mechanical loads caused by differences in the thermal expansion of the individual superheater tubes. At the same time all of the advantages of using T-piece water separating elements are preserved, such as, for example, the possibility of passing on the water-steam mixture to the superheater tubes, which enables a demand-driven regulation of the live steam temperature at the steam outlet of the once-through steam generator through control of the volume of flow medium introduced.

BRIEF DESCRIPTION OF THE DRAWINGS

An exemplary embodiment of the invention is explained in more detail with reference to the drawings.

DETAILED DESCRIPTION OF INVENTION

Figure 1:
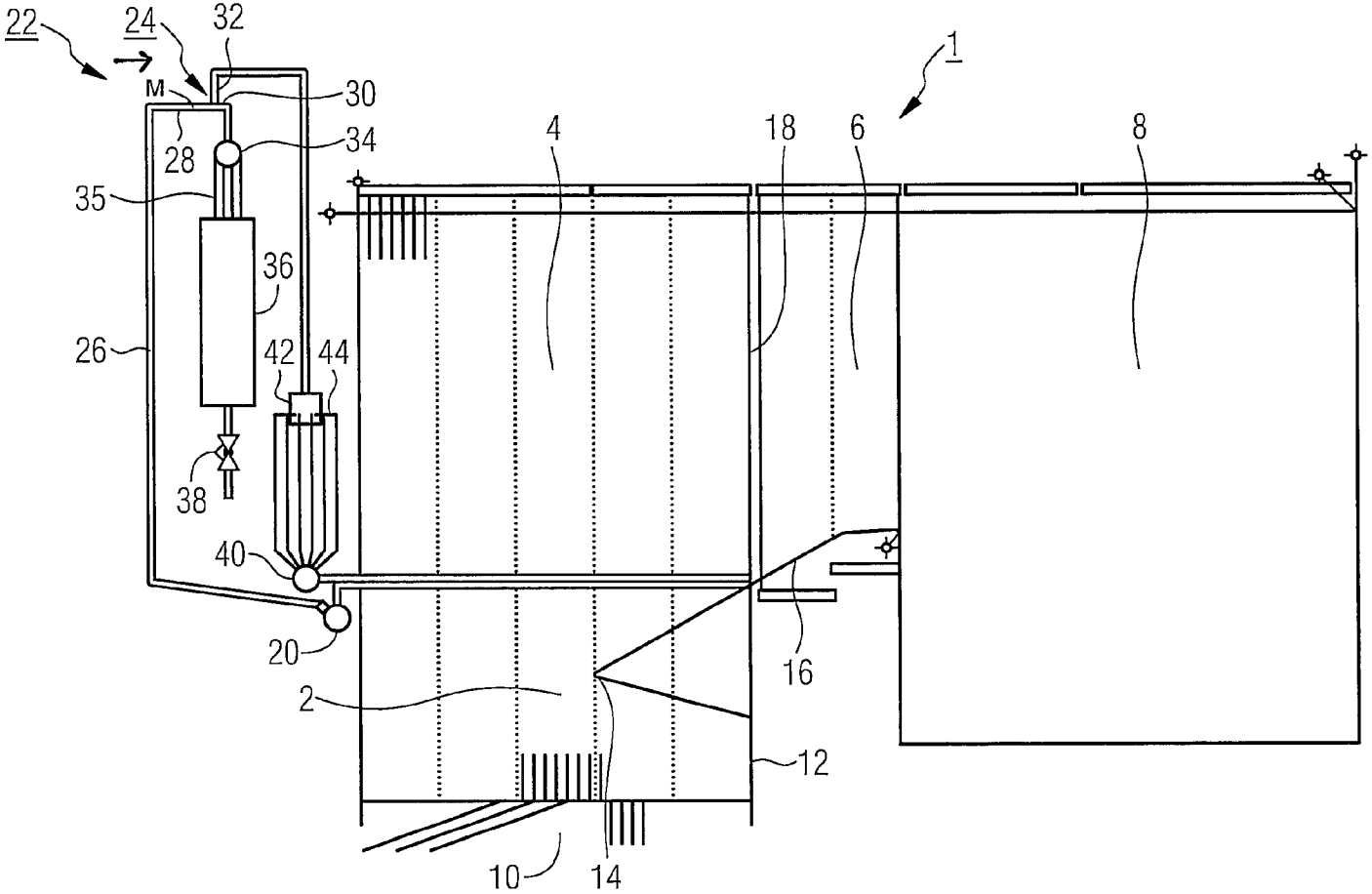
FIG. 1 depicts a once-through steam generator in a two-pass design in a schematic representation.

The once-through steam generator 1 according to the figure comprises a combustion chamber 2 which is embodied as a vertical gas duct and downstream of which a horizontal gas duct 6 is disposed in an upper region 4. A further vertical gas duct 8 is connected to the horizontal gas duct 6.

Provided in the lower region 10 of the combustion chamber 2 are a plurality of burners (not shown in further detail) which combust a liquid or solid fuel in the combustion chamber. The external wall 12 of the combustion chamber 2 is formed from steam generator tubes which are welded to one another in a gas-tight manner and into which a flow medium—typically water—is pumped by means of a pump (not shown in further detail) and heated by means of the heat generated by the burners. In the lower region 10 of the combustion chamber 2 the steam generator tubes can be oriented either in a spiral shape or vertically. Due to differences both in the geometry of the individual tubes and in their heating different mass flows and temperatures of the flow medium (slopes) become established in parallel tubes. A comparatively high constructional overhead is required in a spiral-shaped arrangement, though in return the resulting slopes between tubes connected in parallel are comparatively smaller than in the case of a combustion chamber 2 having a vertical arrangement of tubes.

In order to improve the ducting of the flue gas the once-through steam generator 1 shown additionally includes a projection 14 which transitions directly into the base 16 of the horizontal gas duct 6 and extends into the combustion chamber 2. Also disposed in the transition zone from the combustion chamber 2 to the horizontal gas duct 6 in the flue gas duct is a grid 18 composed of further superheater tubes.

The steam generator tubes in the lower part 10 of the combustion chamber 2 are embodied as evaporator tubes 50. The flow medium is initially evaporated therein and supplied to the water separation system 22 via outlet collectors 20. Water that has not yet evaporated is collected in the water separation system 22 and discharged. This is necessary in particular in the startup phase of operation, when in order to ensure reliable cooling of the evaporator tubes a greater volume of flow medium must be pumped in than can be evaporated in a single pass through the evaporator tube. The generated steam is routed into the walls of the combustion chamber 2 in the upper region 4 and if necessary distributed to the superheater tubes 51 disposed in the walls of the horizontal gas duct 6.

It goes without saying that other configurations for fossil-fired boilers, e.g. in the manner of a tower-type boiler, are also possible in addition to the two-pass boiler shown in the figure. The components that are to be described in the following can be used in all these variants.

The water separation system 22 comprises a plurality of T-piece water separating elements 24. A plurality of evaporator tubes in each case lead via an outlet collector 20 into a common transition tube section 26 downstream of which a T-piece water separating element 24 is connected in each case. The T-piece water separating element 24 comprises an inflow tube section 28 which, viewed in its longitudinal direction, transitions into a water discharge tube section 30, with an outflow tube section 32 branching off in the transition zone. The water discharge tube section 30 leads into a collector 34. A collecting vessel 36 (flask) is connected to the collector 34 downstream via connecting lines 35. Connected to the collecting vessel 36 is an outlet valve 38 via which the separated water can be either discarded or recirculated into the evaporation circuit.

Flow medium M enters the T-piece water separating element 24 through the inflow tube section 28. Due to its mass inertia the water fraction flows into the following water discharge tube section 30 viewed in the longitudinal direction. Owing to its lower mass the steam, on the other hand, follows the diversion into the outflow tube section 32 imposed by the pressure conditions. The superheater tubes are connected downstream of the outflow tube section 32 in the upper region 4 of the combustion chamber 2 and possibly in the grid and in the region of the horizontal gas duct 6 via an inlet collector 40. The steam is superheated in the wall heating surfaces and the following convective heating surfaces and subsequently supplied to its further use; an apparatus (not shown in further detail in the figure) such as a steam turbine is typically provided for example.

If necessary the outlet valve 38 can be closed and in this way an overfeeding of the T-piece water separating elements 24 induced. In this case water that has not yet evaporated enters the superheater tubes, with the result that the latter can continue to be used for further evaporation, i.e. the evaporation endpoint can be shifted into the superheater tubes, thus enabling a comparatively high degree of flexibility in the operation of the once-through steam generator 1.

In order to allow the once-through steam generator 1 to be constructed in a particular simple manner a comparatively small number of T-piece water separating elements 24 should be used. In order to compensate for the inhomogeneities resulting therefrom in terms of the distribution to the superheater tubes and therefore to enable an embodiment of this kind in the first place, distributor elements 42 in the manner of star-type distributors or hubs are interposed between the T-piece water separating elements 24. Said distributor elements ensure a pre-distribution of the flow medium to the inlet collectors 40 in the event of an overfeeding of the T-piece water separating elements 24.

Figure 2:
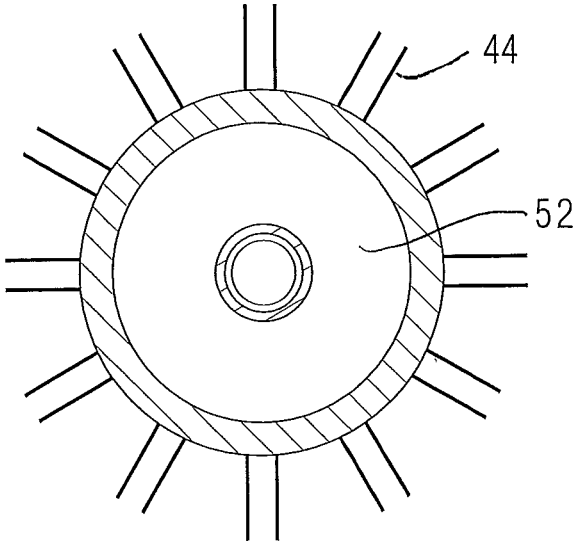
FIG. 2 depicts a circular baffle plate with outlet tubes arranged concentrically-symmetrically in a star shape around the baffle plate.

In the distributor elements 42 embodied as star distributors the flow medium impinges onto a circular baffle plate 52, shown in FIG. 2, and rebounds from there into outlet tubes 44 arranged concentrically-symmetrically in a star shape. In this case, on account of the symmetrical arrangement, roughly the same volume of flow medium is apportioned to each outlet tube 44. Said tubes lead at equal intervals into the inlet collectors 40, which means that a pre-distribution of the flow medium already takes place over the entire width of the inlet collectors 40.

If the flow medium were to be introduced directly via a single line per T-piece water separating element 24 it would not be possible to distribute the flow medium uniformly in the inlet collectors 40, since due to their width the latter are not suitable for a homogeneous distribution of this kind from, for example, a single feed line.

The distributor elements 44 implemented as star distributors therefore enable the once-through steam generator 1 to be constructed more simply and consequently also more economically, since a comparatively small number of T-piece water separating elements 24 can be used. Furthermore, temperature differences are more effectively compensated for owing to the better mixing of the flow medium by comparison with a completely decentralized water separation system having a larger number of T-piece water separating elements 24 and as a result a more homogeneous temperature distribution over the following superheater tubes is achieved. Damage due to differences in thermal expansion of tubes welded to one another is therefore avoided.

The invention claimed is:

1. A continuous steam generator, comprising:

a combustion chamber including a plurality of burners for fossil fuel;

a vertical gas duct disposed downstream of the combustion chamber and connected on a hot gas side in an upper region via a horizontal gas duct;

the horizontal gas duct;

a plurality of superheater tubes;

a plurality of evaporator tubes; and a water separation system, comprising:

a plurality of water separating elements, each including an inflow tube section connected to the respective upstream evaporator tubes, and viewed in a longitudinal direction, transitions into a water discharge tube section, wherein a plurality of outflow tube sections branch off in a transition zone, and are connected to an inlet collector of the respective downstream superheater tubes, and wherein a distributor element is disposed on a steam side of the water separation element between the respective water separating element and the inlet collector, wherein an external wall of the combustion chamber is formed from the plurality of evaporator tubes that are welded to one another in a gas-tight manner and disposed upstream of the water separation system and is formed from the plurality of superheater tubes that are welded to one another in a gas-tight manner and disposed downstream of the water separation system, and wherein the respective distributor element comprises a baffle plate, an inlet tube disposed vertically with respect to the baffle plate, and a plurality of outlet tubes arranged in a star shape around the outside of the baffle plate in the plane thereof such that the flow medium impinges on the baffle plate and is distributed vertically in a symmetrical manner with respect to the inflow direction and conducted into the outlet tubes wherein the plurality of outlet tubes lead at equal intervals into the inlet collector, wherein the baffle plate is circular and the plurality of outlet tubes are arranged concentrically with respect to a center of the baffle plate at equal spacings from the respective adjacent outlet tubes.

2. The continuous steam generator as claimed in claim 1, wherein the geometric parameters of the plurality of outlet tubes of the respective distributor element are chosen such that a homogeneous flow distribution to the inlet collector of the respective downstream superheater tubes is ensured.

3. The continuous steam generator as claimed in claim 1, wherein the respective distributor element comprises between five and twenty outlet tubes.

* * * * *